US006095379A

United States Patent [19]

Martinez et al.

[11] Patent Number: 6,095,379

[45] Date of Patent: Aug. 1, 2000

[54] TAP FOR BOTTLES

[76] Inventors: Marta Perez Martinez; Israel Marcos Perez Martinez, both of Polg. Industrial de Malpica, 50171 La Puebla De Alfinden (Zaragoza), Spain

[21] Appl. No.: 09/275,415

[22] Filed: Mar. 24, 1999

[51] Int. Cl.[7] ..... B65D 83/00

[52] U.S. Cl. ..... 222/402.13; 222/402.25; 222/518

[58] Field of Search ..... 222/518, 402.15, 222/402.13, 402.24, 402.25

[56] References Cited

U.S. PATENT DOCUMENTS

| | | | |
|---|---|---|---|
| 2,632,585 | 3/1953 | Tomasek | 222/402.15 |
| 2,806,638 | 9/1957 | Ziherl et al. | 222/402.15 |
| 5,794,823 | 8/1998 | Roundtree | 222/518 X |

*Primary Examiner*—Joseph A. Kaufman
*Assistant Examiner*—Thach Bui
*Attorney, Agent, or Firm*—Rothwell, Figg, Ernst & Manbeck, p.c.

[57] ABSTRACT

A tap for bottles containing a liquid under pressure comprising a tubular element which defines an intermediate chamber from which extends obliquely an outlet duct and which has a lower opening which functions as a valve seat for a sealing connection mounted on the free end of a stem which is mounted axially in such tubular element and which under the load applied by a compression spring is constantly forced upward where there is mounted an operating lever which may be operated from the exterior. A sealing connection in the form of a skirt is mounted inside the spring, between a circumferential groove in the stem and the bottom of the spring.

1 Claim, 1 Drawing Sheet

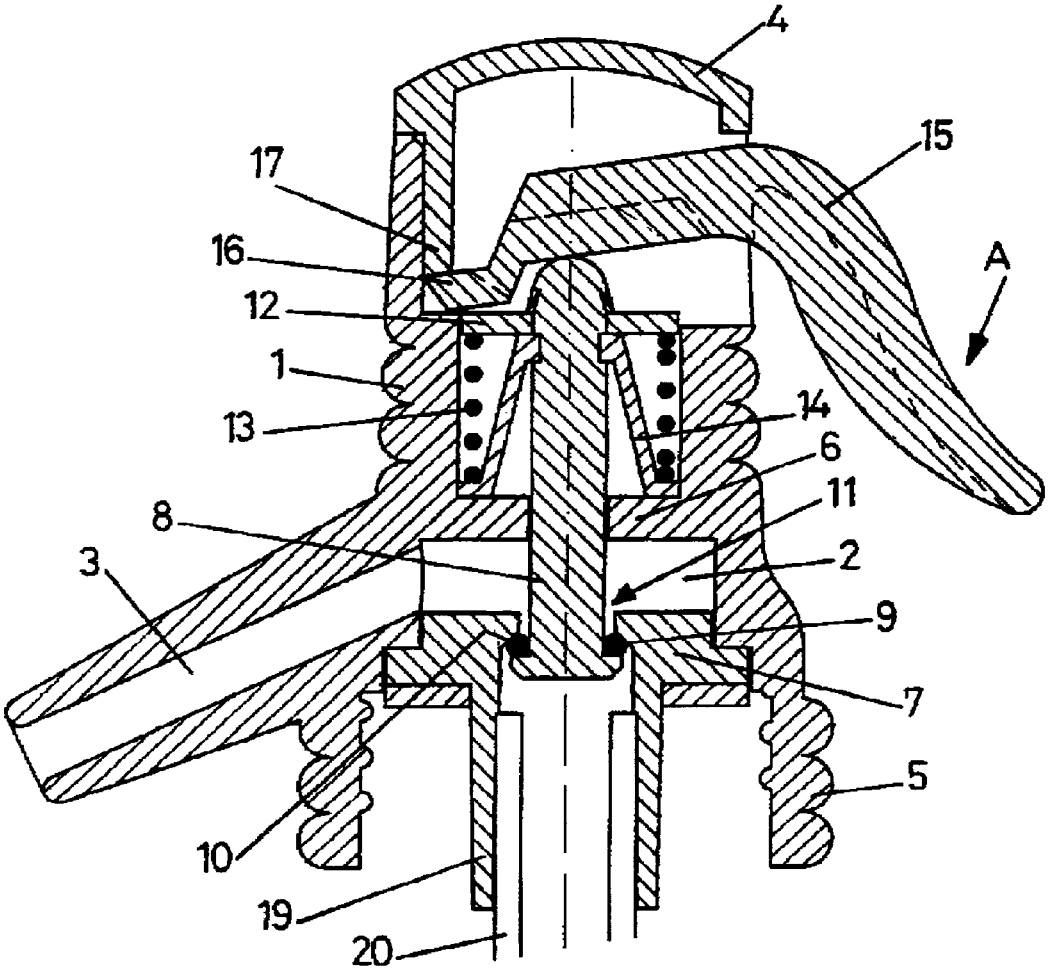
4
15
17
16
A
12
1
13
14
6
11
8
2
3
9
7
5
10
19
20

TAP FOR BOTTLES

BACKGROUND OF THE INVENTION

1. Field of the Invention

This invention relates to a bottle tap designed especially for bottles containing liquids under pressure, one known as a siphon-head tap.

2. Description of the Background Art

Taps for the purpose in question are already known; they comprise a tubular element defining an intermediate chamber from which extends an oblique outlet duct, there being mounted in this element an axial bypass valve which may be operated by means of a lever mounted in the head above the chamber, which lever extends to the exterior for the purpose of its operation.

In taps of the type in question the element ends at the bottom in a casing which may be fitted on the mouth or edge of the neck of a bottle, while at the top it is closed by a stationary cover anchored to the body.

In taps of the type in question the valve includes a sealing element which remains inside the intermediate chamber and is in its entirety in contact with the liquid which is delivered through the valve, with the result that certain forms of contamination may result from friction and deterioration of the sealing connection.

SUMMARY OF THE INVENTION

The object of the invention is to eliminate the problem as stated by means of a tap simple in structure and dependable in operation, one in which there is no large sealing element in direct contact with the liquid.

It is claimed for this invention that the valve of the tap is made up of a stem which extends coaxially through the intermediate chamber and projects below the latter as a section bearing a sealing connection capable of coming to rest upward against the valve seat defined by the edge of the bypass opening of this stem, thereby shutting off passage of liquid through such opening. Above the intermediate chamber the stem projects as a section which ends in a head between which and a lower support which outlines the body itself of the valve, above the intermediate chamber, there is mounted a spring which constantly applies pressure upward to the stem so that this stem is forced to rest against the sealing connection of the stem with the seat referred to in order to effect the closing of the tap.

As for the operating lever, one of its ends enters the body of the tap above the intermediate chamber and its free end extends upward and rests against a fixed stop on the head, while it extends downward though an intermediate support point to come to rest against the upper end of the stem. In this configuration application of downward pressure to the exterior end of the lever results in application of downward pressure to the stem until the force of the spring is overcome, this causing displacement of this stem downward until the sealing connection of the seat is broken, this allowing passage of liquid from the interior of the bottle to the intermediate chamber and from the latter to the exterior through the oblique outlet duct.

The characteristics of the tap claimed for the invention are explained in greater detail below with reference to the attached drawing, in which a non-restrictive embodiment in shown in cross-section.

BRIEF DESCRIPTION OF THE DRAWINGS

FIG. 1 shows a bottle tap of the present invention.

DETAILED DESCRIPTION OF THE PREFERRED EMBODIMENTS

The tap shown in FIG. 1 comprises a tubular element 1 in which there is defined an intermediate chamber 2 from which an oblique outlet duct 3 extends. The element 1 is closed at the top by means of a cover 4. At the bottom the element 1 is in the form of an adjustable coupling or mouth 5 on the end of the neck of a bottle.

The intermediate chamber 2 in the example illustrated in the drawing is bounded by an intermediate wall 6 and a disc-shaped cover 7 which is fastened to the bottom of the tubular element 1.

There is mounted inside the element 1 a valve which in the tap claimed for the invention is made up of a stem 8 which extends coaxially through the intermediate chamber 2, as well as the intermediate wall 6 and the bottom cover 7. On its lower end this stem has an annular sealing connection 9 which comes to rest upward against a seat 10 formed around the opening 11 through which the stem 8 extends.

Above the intermediate wall 6 the stem 8 extends in the form of a section having at the end a head 12 between which and the intermediate wall 6 there is introduced a compression spring 13 which constantly forces the stem 8 upward until the sealing washer 10 rests against the seat 10, thereby shutting off any passage through the opening 11.

The head 12 may be in the form of a washer fastened at the upper end of the stem 8.

Above the intermediate wall 6 the stem 8 may have mounted on it a sealing connection 14 in the form of a skirt fastened by its upper edge to the stem 8, while the lower edge is retained between the spring 13 and the intermediate wall 6.

Below the cap 4 there extends through the upper part of the element 1 an operating lever 15 the interior end 16 of which comes to rest upward against a stationary stop 17, while an intermediate point rests against the upper end of the stem 8.

In the configuration in question, when force is not applied to the lever 15, the spring 13 forces the stem 8 upward until the annular sealing connection 9 rests against the seat 10, thereby preventing passage through the opening 11. For the purpose of opening the tap, pressure is applied to the lever 15 in the direction of arrow A, which pressure acts on the upper end of the stem 8, forcing it downward. When the force applied to the lever 15 overcomes the force of the spring 13, the stem moves downward until the toroidal sealing connection 8 of the seat 10 is opened to allow passage of liquid through the opening.

The lower cover 7 has a neck 19 into which there may be inserted a tubular section through which the liquid contained in the bottle into which the tap is introduced may rise when the tap is opened in the manner described.

As soon as pressure on the lever 15 is released, the spring 13 forces the lever in question and the stem 8 toward resumption of their former positions until the toroidal sealing connection 9 comes to rest again against the seat 10, thereby again cutting off the flow of the liquid.

What is claimed is:

1. A tap for bottles, comprising:

a tubular element which defines an intermediate chamber from which extends an oblique outlet duct, in the tubular element there is mounted an axial bypass valve which is operated by means of an operating lever mounted on a head above the intermediate chamber, characterized that the axial bypass valve is made up of a stem which extends coaxially through the intermediate chamber and projects below the intermediate chamber and also of a section carrying an annular sealing connection capable of coming to rest upward against a seat defined by an edge of a bypass opening of the stem, thereby shutting off flow through the bypass opening, while at a top portion the stem projects as a section ending in a head which in between the stem and an intermediate support outlining the tubular element above the intermediate chamber there is mounted a spring which constantly forces the stem upward until the sealing connection of the stem comes to rest against the seat referred to; and in that a free end of the operating lever comes to rest upward against a stationary stop of the head inside the tubular element, and downward against an intermediate point on an upper end of the stem, and wherein the stem has mounted above the intermediate chamber a sealing sleeve or skirt having an upper edge resting against the stem, and a lower edge retained between the spring and the intermediate support against which the spring rests.

* * * * *